US005291868A

United States Patent [19]

Nonogawa et al.

[11] Patent Number: 5,291,868

[45] Date of Patent: Mar. 8, 1994

[54] SINGLE OVERHEAD CAM MULTI-VALVE ENGINE

[75] Inventors: Kenichi Nonogawa; Makoto Shimamoto; Wataru Fuchigami, all of Iwata, Japan

[73] Assignee: Yamaha Motor Co. Ltd.

[21] Appl. No.: 734,180

[22] Filed: Jul. 22, 1991

Related U.S. Application Data

[63] Continuation-in-part of Ser. No. 619,907, Nov. 28, 1990, Pat. No. 5,230,317.

[30] Foreign Application Priority Data

| | | | |
|---|---|---|---|
| Nov. 29, 1989 | [JP] | Japan | 1-309466 |
| Nov. 29, 1989 | [JP] | Japan | 1-309467 |
| Nov. 29, 1989 | [JP] | Japan | 1-309469 |
| Nov. 29, 1989 | [JP] | Japan | 1-309470 |

[51] Int. Cl.[5] ..... F02B 15/00

[52] U.S. Cl. ..... 123/432; 123/90.22; 123/188.1

[58] Field of Search ..... 123/308, 432, 188 M, 123/52 M, 90.22, 90.23, 90.27, 90.43, 193 H, 193 CH

[56] References Cited

U.S. PATENT DOCUMENTS

| | | | |
|---|---|---|---|
| 4,627,400 | 12/1986 | Takata et al. | 123/432 |
| 4,638,774 | 1/1987 | Aoi | 123/90.22 |
| 4,679,532 | 7/1987 | Aoi et al. | 123/90.22 |
| 4,683,855 | 8/1987 | Laimbock | 123/432 |
| 4,766,866 | 8/1988 | Takii et al. | 123/432 |
| 4,819,591 | 4/1989 | Valentine | 123/90.27 |
| 4,860,709 | 8/1989 | Clarke et al. | 123/432 |
| 4,979,474 | 12/1990 | Morishita | 123/90.27 |
| 5,009,200 | 4/1991 | van Basshuysen | 123/432 |
| 5,056,486 | 10/1991 | Johannes | 123/432 |
| 5,060,605 | 10/1991 | Yamazaki | 123/90.27 |

FOREIGN PATENT DOCUMENTS

| | | |
|---|---|---|
| 0144179B1 | 2/1988 | European Pat. Off. . |
| 62-43050 | 9/1978 | Japan . |
| 235844 | 1/1986 | Japan . |
| 62-93123 | 6/1987 | Japan . |
| 2-18603 | 7/1988 | Japan . |
| 261325 | 8/1988 | Japan . |
| 240904 | 9/1988 | Japan . |
| 1-4045 | 6/1989 | Japan . |
| 31523 | 6/1989 | Japan . |
| 1-145907 | 10/1989 | Japan . |

*Primary Examiner*—E. Rollins Cross
*Assistant Examiner*—Erick Solis
*Attorney, Agent, or Firm*—Knobbe, Martens, Olson & Bear

[57] ABSTRACT

Several embodiments of internal combustion engines having at least five valves, three intake and two exhaust, all operated by a single camshaft. The intake valves are disposed so as to provide a smooth combustion chamber configuration by minimizing the difference in angle between the valves and the valves and rocker arms are arranged so that different degree of lift may be provided. All of the intake valves have the same stem length. One rocker arm operates one valve and another rocker arm operates two valves with the two valves being operated being differently configured so as to provide the desired different lift. In addition, a staged intake system is included that has a single intake passage that extends perpendicular to a plane containing the cylinder bore axis and serving one intake valve and a siamese intake passage serving the other intake valves. The siamese intake passage has a section that extends also perpendicularly to the plane.

50 Claims, 10 Drawing Sheets

SINGLE OVERHEAD CAM MULTI-VALVE ENGINE

This application is a continuation-in-part of our application Ser. No. 619,907 filed Nov. 28, 1990, now U.S. Pat. No. 5,230,317.

BACKGROUND OF THE INVENTION

This invention relates to a single overhead cam multi-valve engine and more particularly to an improved valve orientation, valve operating mechanism and induction system for such an engine.

It has been recognized that the performance of an internal combustion engine can be improved by increasing the number of intake valves for the engine. The use of two intake valves for high performance engine has been widely accepted. Although an even greater number of intake valves may improve induction efficiency, there are some difficulties in providing more than two intake valves for a given cylinder. Specifically, as the number of intake valves is increased beyond two, it is difficult to obtain a compact combustion chamber and, accordingly, a high compression ratio. In addition, the combustion chamber configuration may be less than optimum if more than two intake valves are employed. That is, it is difficult to obtain the desired spherical combustion chamber configuration if more than two intake valves are employed. Furthermore, if more than two intake valves are employed the combustion chamber, particularly in the area where the valves seats are adjacent to each other can become irregular.

It is, therefore, a principle object of this invention to provide an improved valve arrangement and cylinder head for an internal combustion engine in which at least three intake valves may be employed.

It is a further object to this invention to provide a cylinder head arrangement for an internal combustion engine having at least three intake valves that will have a smooth combustion chamber configuration.

It is a further object of this invention to provide an improved arrangement for the cylinder head of an internal combustion engine that permits the use of three or more intake valves while maintaining a compact combustion chamber and one having a smooth configuration.

In conjunction with the use of two or more valves, it has been found that the combustion chamber configuration can be better made if the valves are disposed at different acute angles to a plane containing the axis of the cylinder bore. Where this is done, however, in order to simplify the operation of the valves, it has been proposed to employ valves having different length stems for the same purpose. This gives rise to obvious disadvantages both in assembly and in servicing the engine plus it requires the inventorying of a greater number of parts.

It is, therefore, a further object of this invention to provide a cylinder head arrangement for an internal combustion engine employing plural valves that are angularly disposed but which all have the same length stems.

In addition to the difficulties in connection with the combustion chamber configuration with the use of multiple valves, there is also a problem in connection with the actuation of the valves. This is particularly true if it is desired to simplify the cylinder head arrangement and only employ a single camshaft for opening at least all of the intake valves. Furthermore, if it is desired to simplify the cylinder head in such a way that only a single camshaft is employed for operating all of the valves, then further problems arise.

It is, therefore, a still further object of this invention to provide an improved multi-valve single overhead camshaft engine.

It is another object of this invention to provide an improved valve arrangement for a single overhead camshaft engine having at least five valves operated by the single camshaft.

When multiple intake valves are employed, there may be certain advantages in having the valve opening areas be different. That is, the effective opening area of the valve is equal to its circumference multiplied by its lift. In some instances it may be desirable to provide valves which have the same diameter of the head but which have different degrees of lift so as to provide desired flow patterns within the cylinder. For example, if one intake valve has a greater effective flow area than others the smaller flow area will tend to cause a higher velocity within the cylinder and can influence the air flow therein. However, when employing an arrangement wherein multiple valves are operated from a single camshaft, than there may be some difficulty in providing different opening and closing characteristics for the valves.

It is, therefore, a still further object of this invention to provide an improved arrangement for varying the valve events of multiple valves operated by a single overhead camshaft.

It is a further object of this invention to provide an arrangement wherein two valves are operated by a common rocker arm and wherein the valves have different lifts but the valves have the same stem length.

When employing multiple intake valves it is possible to provide throttle valve arrangements so that a lesser number of valves serve the engine at low speed operation than high speed operation. Such an arrangement permits the achievement of different flow patterns within the cylinder under different running conditions and, furthermore, can improve combustion efficiency. However, in order to accommodate good low speed running it is desireable to insure that the valve which serves the engine's low speed requirements is served by an intake passage that has a relatively small volume. This insures good response upon opening and closing of the valve. Although it may be possible to provide a low volume by decreasing the cross sectional area of the intake passage, this gives rise to flow restriction. Therefore, it is desireable to maintain a short length for such an intake passage. However, it is not always possible to do this when there are multiple intake passages serving the same cylinder.

It is, therefore, a still further object of this invention to provide an improved induction system for an internal combustion engine having multiple intake valves and wherein the flow passages associated with the valves are optimumly placed.

It is a further object of this invention to provide an improved arrangement for a multiple valve engine wherein effective induction passages are provided for each valve and wherein it is possible to utilize short passages for as many valves as possible.

In staged induction systems, it is also desireable if the intake valves can be operated in such a manner that the intake valve timing and lift is tailored for the running condition for the engine which it serves. However, when multiple intake valves are employed and it is desired to operate them from a single camshaft, this can give rise to additional problems.

It is, therefore, a still further object of this invention to provide an improved valve operating mechanism for a multiple valve engine wherein all valves can be operated by a single camshaft and the timing and lift of one valve may be different from those of the other valves and yet the valves all have the same stem length.

SUMMARY OF THE INVENTION

A number of features of the invention are adapted to be embodied in a cylinder head and valve arrangement for an internal combustion engine that comprising a cylinder head assembly that is adapted to be affixed in sealing relation to an associated cylinder block for closing a cylinder bore therein. A pair of poppet valves are supported for reciprocation within the cylinder head assembly about respective reciprocal axes each of which is disposed at a different acute angle to a plane containing the axis of the cylinder bore. A camshaft is journaled for rotation about a rotational axis lying contiguous to the plane.

In accordance with a first feature of the inventions, the axes of reciprocation of the valves intersect at a line that extends parallel to the plane at a point spaced from the tips of the valves and rocker arm means operate the valves from the camshaft. The valves all have the same stem length.

In accordance with a second feature of the invention, the tips of the valves lie at different distances from the associated cylinder block and rocker arm means operate the valves from the camshaft and the valves all have the same stem length.

In accordance with a third feature of the invention, the tips of the valves lie a different distances from the plane and rocker arm means operate the valves from the camshaft and the valves all have the same stem length.

In accordance with a fourth feature of the invention, rocker arm means operate the valves from the camshaft and the rocker arm means are pivotal about an axis that extends parallel to the plane. The axes of reciprocation of the valves are spaced different perpendicular distances from the rocker arm pivotal axis and the valves all have the same stem length.

A fifth feature of the invention is embodied in an internal combustion engine having a combustion chamber defined at least in part by a cylinder head. A first intake passage extends through the cylinder head and terminates at a first valve seat, a second intake passage extends through the cylinder head and terminates at a second valve seat. A third intake passage extends through the cylinder head and terminates at a third valve seat. First, second and third poppet type intake valves are supported for reciprocation by the cylinder head for controlling respectively the flow through the first, second and third valve seats. Throttle valve means are provided for controlling the flow through the intake passages so that only the first intake passage serves the combustion chamber under certain running conditions. A camshaft is journaled for rotation by the cylinder head and first rocker arm is pivoted by the camshaft for opening one of the intake valves. A second rocker arm is operated by the camshaft and operates the remaining intake valves. The valves all have the same stem length.

DETAILED DESCRIPTION OF THE PREFERRED EMBODIMENTS OF THE INVENTION

Figure 1:
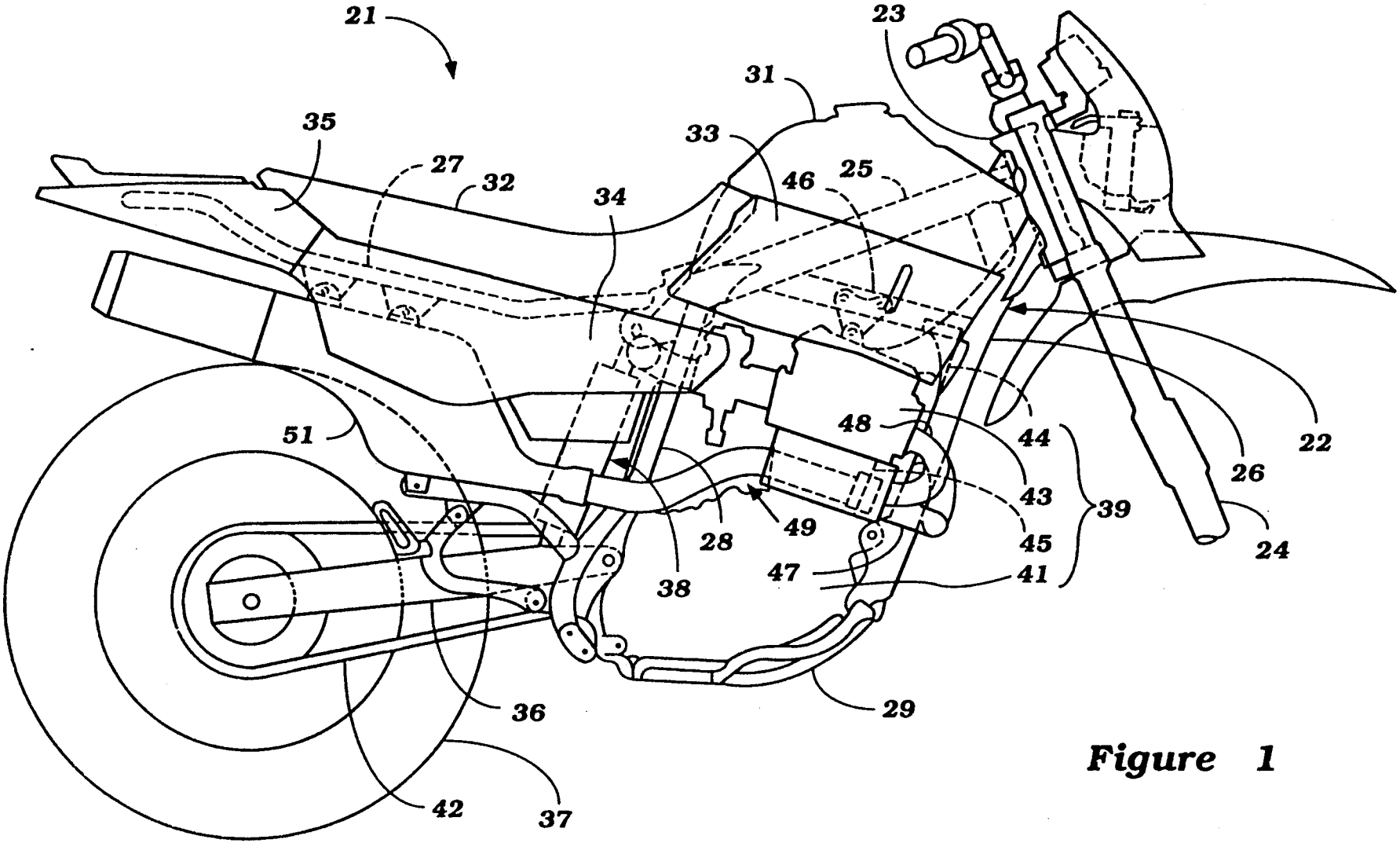
FIG. 1 is a partial side elevational view of a motorcycle powered by an internal combustion engine constructed in accordance with a first embodiment of the invention.

Referring first to FIG. 1, a motorcycle powered by an internal combustion engine constructed in accordance with an embodiment of the invention is identified generally by the reference numeral 21. The invention is described in conjunction with a motorcycle since it has particular utility in conjunction with such this type of vehicle. It is to be understood, however, that certain facets of the invention may be utilized in conjunction with internal combustion engines that power other types of vehicles or, for that matter, other applications for internal combustion engines.

The motorcycle 21 includes a welding frame assembly 22 having a head pipe 23 that journals a front fork 24 for steering movement. A front wheel (not shown) is journaled by the front fork 24 in a known manner.

The frame 22 further includes a main frame tube 25, a down tube 26, a seat rail 27 and a seat pillar 28. At the lower end of the frame, an underguard 29 spans the down tube 26 and the seat pillar 28.

A fuel tank 31 is positioned behind the head pipe 23 and ahead of a seat 32 that is carried by the seat rail 27. A small body assembly comprised of a side cover for the tank 31 and air scoop 33, a side covering for the lower portion of the seat 34 and a rear cover 35 are suitably affixed to the frame 22.

A trailing arm 36 suspends a rear wheel 37 from the frame assembly in a suitable manner, including a combined spring shock absorber 38 that lies generally on the longitudinal center plane of the motorcycle 21.

The rear wheel 37 is powered by an engine unit 39 which is comprised of a water cooled, single cylinder, four cycle, five valve, single overhead cam engine. A crankcase assembly 41 of the engine unit 39 contains a change speed transmission which is driven by the engine crankshaft and which drives the rear wheel 37 through a chain 42. Although the details of the engine unit 39 and specifically the engine portion of it will be described by references to the remaining figures, the engine unit 39 includes a cylinder head 43, a cam cover 44 and a cylinder block 45 in addition to the crankcase 41. This engine unit is mounted in the frame 22 with the cylinder block 45 inclined slightly forward in a suitable manner by means including a support pipe 46 that is positioned beneath the main pipe 25 and which is joined to the main pipe 25 and the down tube 26.

As will become apparent, the engine unit 39 has a pair of forwardly facing exhaust ports from which a pair of exhaust pipes 47 and 48 extend into an exhaust system, indicated generally by the reference numeral 49 and which includes a side mounted muffler 51.

Figure 8:
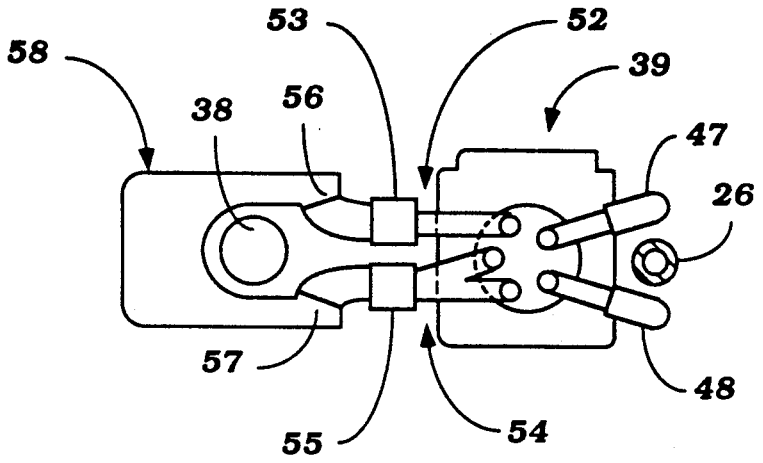
FIG. 8 is a partially schematic top plan view showing the orientation of the intake and exhaust passages and their relationship to the certain components of the motorcycle.

The engine unit 39 also includes an induction system including an air box which is not shown in FIG. 1 that supplies air to a pair of carburetors which serve three rearwardly facing exhaust ports, as will be described by reference to the remaining figures. This induction system is best shown in FIG. 8 wherein it is illustrated schematically. The induction system includes a primary induction system 52 including a primary carburetor 53 and a secondary system 54 including a secondary carburetor 55. Both carburetors 53 and 55 draw air through respective inlets 56 and 57 that communicate with the aforenoted air box 58. As may be seen in FIG. 8, the configuration of the components is such that the exhaust pipes 47 and 48 extends on opposite sides of the down tube 26 while the air box 58 encircles the spring shock absorber unit 38 so as to provide a very compact assembly and yet one which will not interfere with the basic construction of the motorcycle or adversely affect the design of the engine.

Figure 3:
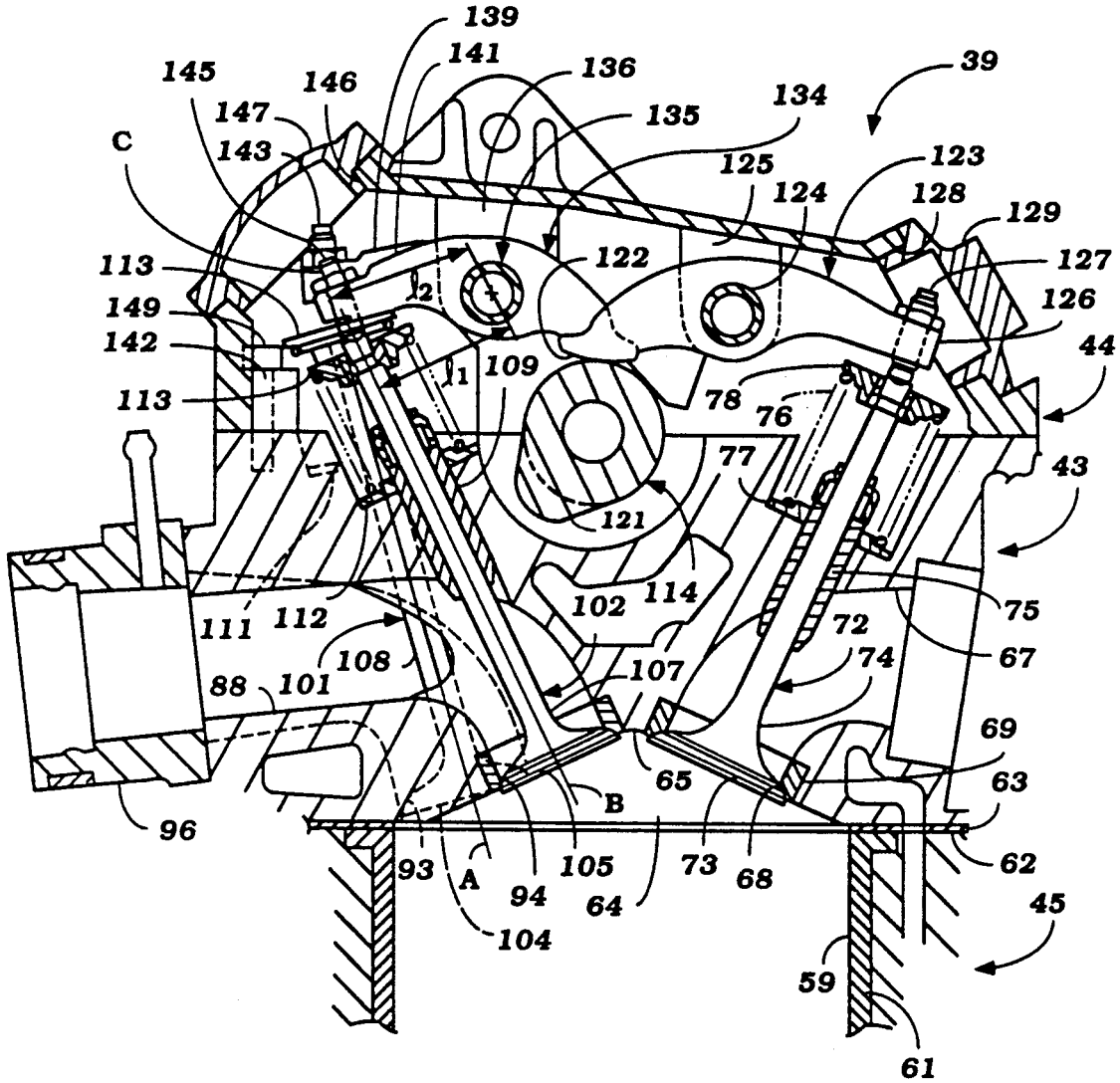
FIG. 3 is a cross sectional view of the complete cylinder head assembly and a portion of the associated cylinder block taken along the line 3—3 of FIG. 2.
Figure 4:
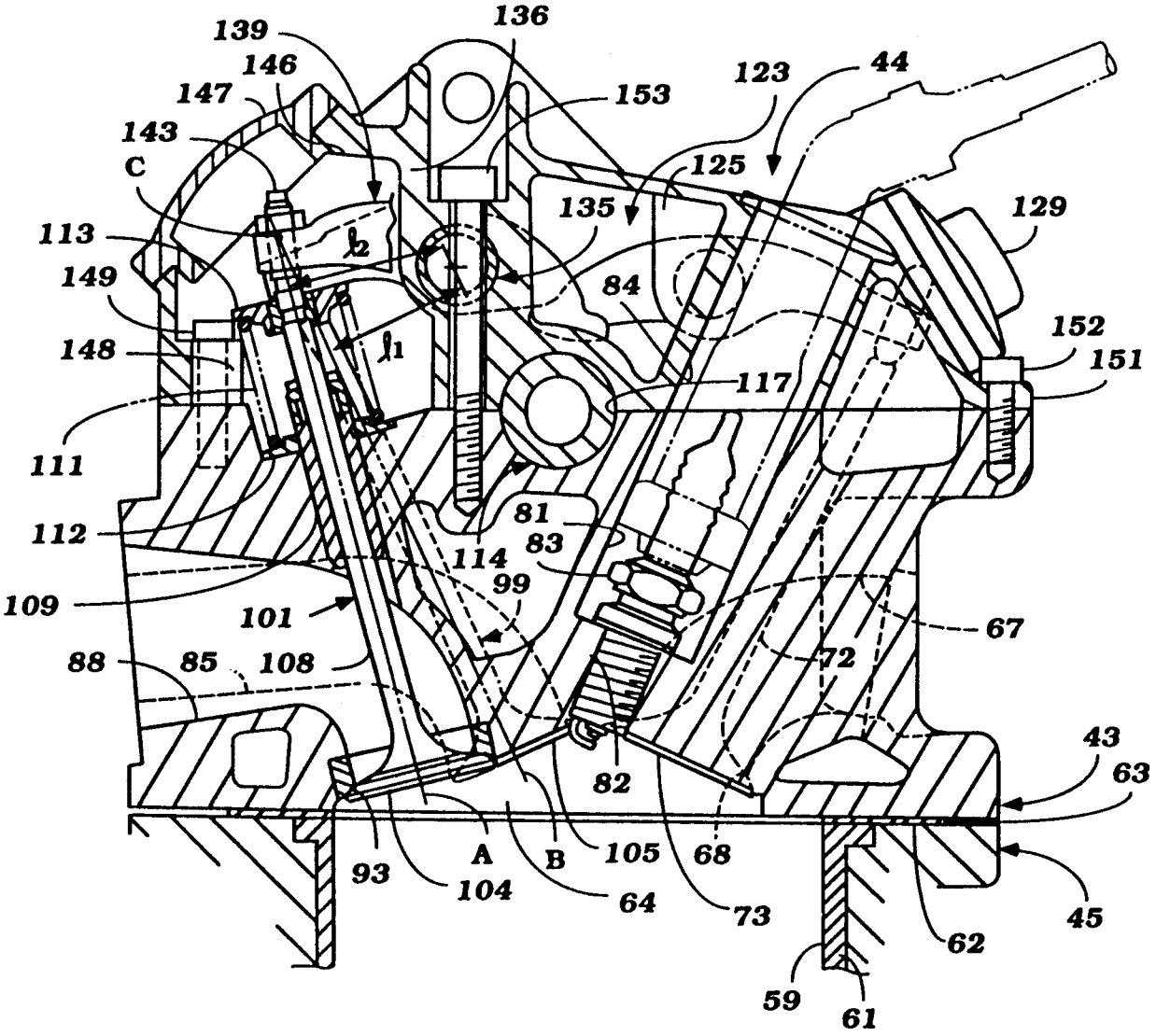
FIG. 4 is a cross sectional view taken along the line 4—4 of FIG. 2.
Figure 5:
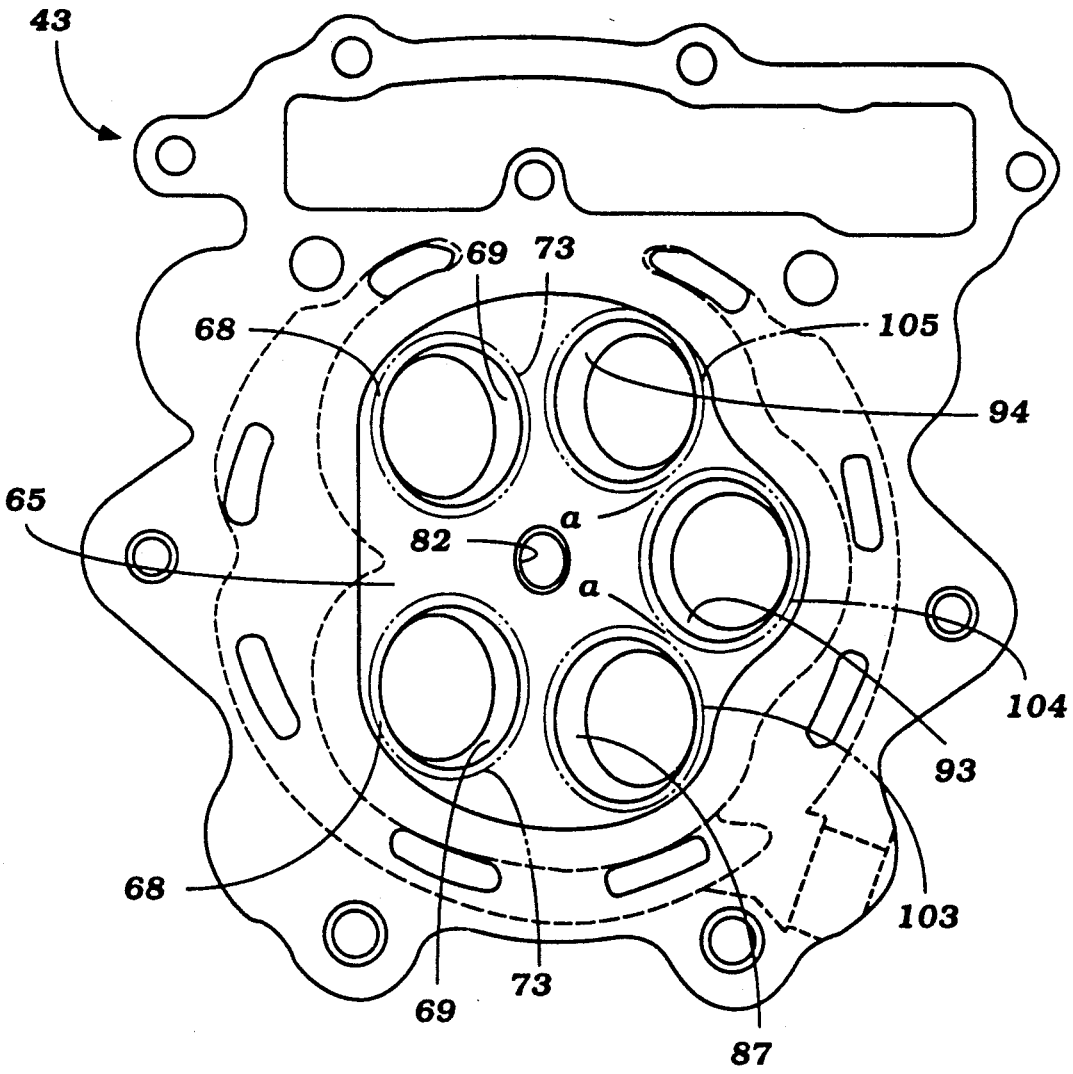
FIG. 5 is a bottom plan view of the cylinder head with the valves and spark plug removed.
Figure 6:
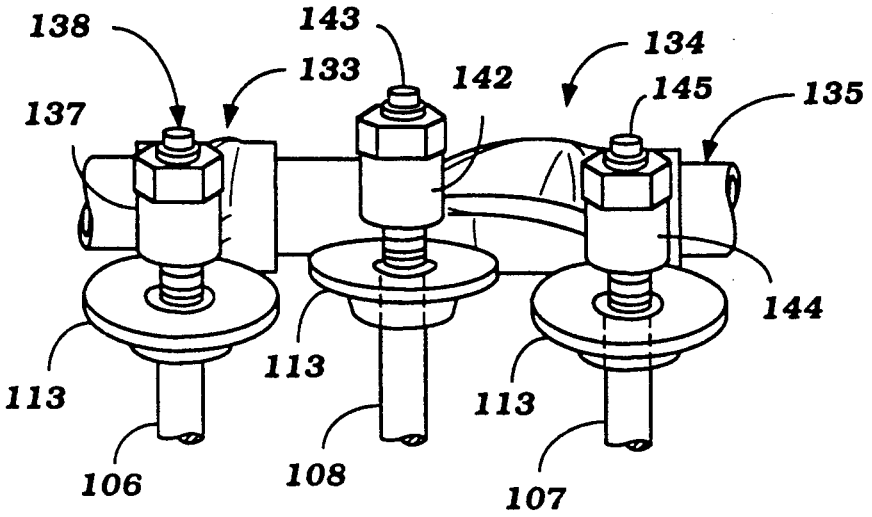
FIG. 6 is an enlarged elevational view showing the intake rocker arms and their association with the tips of the intake valves.
Figure 7:
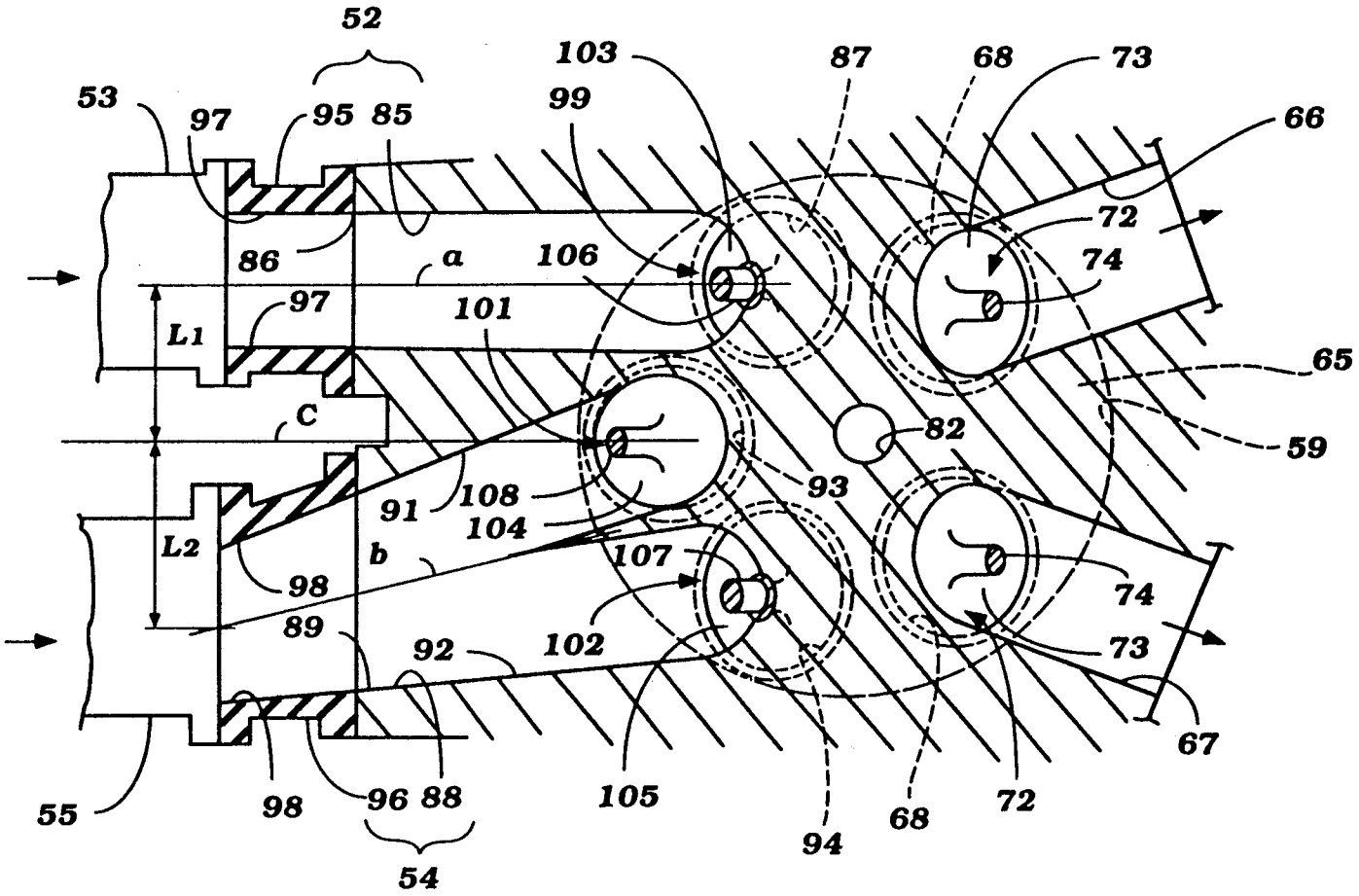
FIG. 7 is a cross sectional view of the cylinder head taken through the intake and exhaust ports to show the configuration of their passages.

Referring now to FIGS. 3 and 4, it will be noted that the cylinder block 45 is formed with a cylinder bore 59 which is formed by a pressed or cast in liner 61. A piston (not shown) reciprocates within the cylinder bore 59 and drives the crankshaft (not shown) contained within the crankcase 41 in a well known manner. Since the invention deals primarily with the cylinder head 43 and valve train associated with it, those components of the engine which are considered to be conventional have not been illustrated and further description of them is not believed to be necessary to enable those skilled in the art to practice the invention.

The cylinder head 43 has a lower surface 62 that is sealingly engaged with a head gasket 63 so as to provide a seal with the cylinder block 45 around the cylinder bore 59. In addition, the cylinder head 43 is formed with a generally central recess 64 which recess is defined by a surface 65 surrounded by the lower cylinder head surface 62. This recess has a generally spherical configuration although it assumes a pent roof type of configuration as may be best seen in FIGS. 3 and 4.

Referring now primarily to FIGS. 2 through 7, the cylinder head 43 is formed with a pair of forwardly facing exhaust passages 66 and 67 each of which extends from the combustion chamber 66 through a valve seat 68 formed by a pressed in insert 69. These exhaust passages 66 and 67 terminate in forwardly facing exhaust ports 71 to which the respective exhaust pipes 47 and 48 are affixed in a suitable manner.

A pair of exhaust valves 72 each of which has a head portion 73 and a stem portion 74 are slidably supported for reciprocation within the cylinder head 43 by a respective pressed in valve guide 75. The exhaust valves 72 reciprocate within a common plane that is inclined at an acute angle to a plane containing the axis D (FIG. 2) of the cylinder bore 59. The axes of reciprocation also lie in planes that are parallel to each other and to the cylinder bore axis D. This facilitates operation of the valve although they may be slightly inclined if desired. The exhaust valves 72 are urged to their closed positions by means of respective coil compression springs 76 that engage wear plates 77 bearing against the cylinder head 43 and keeper retainer assemblies 78 affixed in a known manner to the upper ends of the exhaust valve stems 74. The exhaust valves 72 are opened in a manner which will be described.

It should be noted that the exhaust passages 66 and 67 are disposed at an angle to the plane containing the cylinder bore axis D and thus diverge from a plane perpendicular to this plane and also passing through the cylinder bore axis D. This permits the exhaust pipes 47 and 48 to clear the down tube 26 as clearly shown in FIG. 8 and also provides a better and less flow resistant path for the entire exhaust system.

A spark plug well 81 is formed in the cylinder head 43 between the exhaust passages 66 and 67 and terminates at a threaded opening 82 in which a spark plug 83 is received. The spark plug 83 is disposed so that its gap lies substantially on the cylinder bore axis D. A corresponding well 84 is formed in the cam cover 44 so as to facilitate insertion and removal of the spark plug 83 without removing the cam cover 44. The spark plug 83 is fired by a suitable ignition system.

A primary intake passage 85 extends through the opposite side of the cylinder head 43 from the exhaust side already described. The passage 85 extends from an intake port 86 formed in the side of the cylinder head 43 and terminates at a valve seat 87 formed by a pressed in insert. As may be best seen in FIGS. 7 and 8, the primary intake passage 85 has a central axis a that is generally perpendicular to the aforenoted plane containing the cylinder bore axis D and hence as a relatively short length from its intake port 86 to its valve seat 87. As a result, good, low and mid range performance and good response may be achieved. This passage 85 and its central axis a is disposed at a distance L1 from a plane C which plane contains the axis of the cylinder bore D. The significance of this will be as described.

Figure 9:
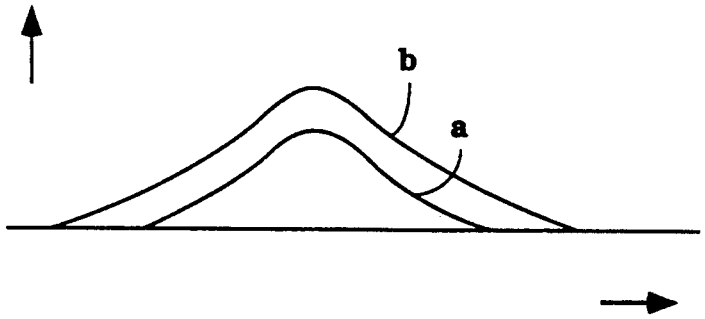
FIG. 9 is a graphical view showing the timing events associated with the two intake lobes of the camshaft.

A siamese type secondary intake passage 88 extends from an intake port 89 formed in the intake side of the cylinder head 43 and branches into a pair of passages 91 and 92 each of which terminates at a respective valve seat comprised of a center valve seat 93 and a side valve seat 94. The center of the intake port 89 as extended by a spacer, to be described, is disposed at a distance L2 from the place C which distance is the same as the distance L1. The carburetors 53 and 55 are affixed to these respective intake ports 86 and 89 through the intermediary of respective spacers 95 and 96 which have respective passage ways 97 and 98 that form extensions of the cylinder head intake passages 85 and 88. By utilizing the spacers it is possible to have this equal distance between the centers of the ports even though the actual port 89 is closer to the plane C than is the inlet of the passage 98 and its spacer. This construction permits the induction system to clear the shock absorber and spring assembly 38 as seen in FIG. 9 and avoids interference between the carburetors 53 and 55.

A central effective line or bisector b of the secondary intake passage 88 lies at an acute angle to the plane C while the portion 92 extends generally perpendicularly to the plane containing the axis of the cylinder bore D as aforenoted. As a result, the intake passages serving the side valve seats 87 and 94 are relatively short while the passage 91 is somewhat longer. This variation in length can be employed so as to achieve the desired flow pattern in the engine as will be described.

The carburetor 53 is sized and jetted and has a throttle valve (not shown) that functions to control both the low speed and mid range performance of the engine as well as the high speed performance. The throttle valve (not shown) of the carburetor 55 is operated in a staged sequence with the carburetor of the throttle valve 53 and the carburetor 55 may only have high speed circuits since this carburetor supplies the fuel air charge only to the engine under high speed operation. Either a staged linkage system or some form of load or speed responsive control (such as a vacuum responsive servo motor) can be employed for operating the throttle valve of the carburetor 55 in this staged sequence.

First, second and third poppet type intake valves 99, 101 and 102 have respective head portions 103, 104 and 105 which cooperate with the valve seats 87, 93 and 94 for controlling the flow through them. The intake valves 99 and 102 are side valves and have their respective stem portions 106 and 107 slidable supported in guides, to be described, for reciprocation about axes B which are in a common plane disposed at an acute angle to the plane containing the cylinder bore axis D which acute angle may be substantially the same as the acute angle of reciprocation of the exhaust valves 72. The center intake valve 101 has its stem portion 108 supported for reciprocation about an axis A which is disposed also at an acute angle to the aforenoted plane containing the cylinder bore axis D but which acute angle is lesser than the angle of reciprocation B of the valves 99 and 101. The lengths of the stems portion 106, 107 and 108 of the valves 99, 102 and 101 all have the same length so that a single valve may be used for each location.

The angular disposition of the reciprocal axes A & B is such that these axes intersect a line C which is parallel to the plane containing the cylinder bore axis D but which is spaced from the tips of the individual intake valves 99, 101 and 102. As a result of this, the angular configuration of the side valves 99 and 102 relative to the center valve 101 is relatively small. This configuration permits the adjacent area between the intake valves as indicated at "a" in FIG. 5 to be relatively smooth and thus provide a smooth combustion chamber configuration that will avoid hot spots and still permit a generally spherical configuration.

The axes A & B of reciprocation of the intake valves 101 and 99 and 102 all lie in parallel planes which planes are parallel to the axis of the cylinder bore D. This permits ease of operation. However, if desired, these axes may be slightly skewed from parallel planes as is also possible with the exhaust valve 72, as previously noted.

The valve guides that slidable support the stems 106, 107 and 108 of the intake valves 99, 102 and 101 are each indicated by the reference numeral 109. Intake valve springs 111 engage bearing plates 112 that bear against the cylinder head 43 and keeper retainer assemblies 113 affixed to the upper ends of the respective valve stems for urging the intake valves 99, 101 and 102 to their closed positions. The intake valves 99, 101 and 102 are operated by means of rocker arm assemblies to be described.

Figure 2:
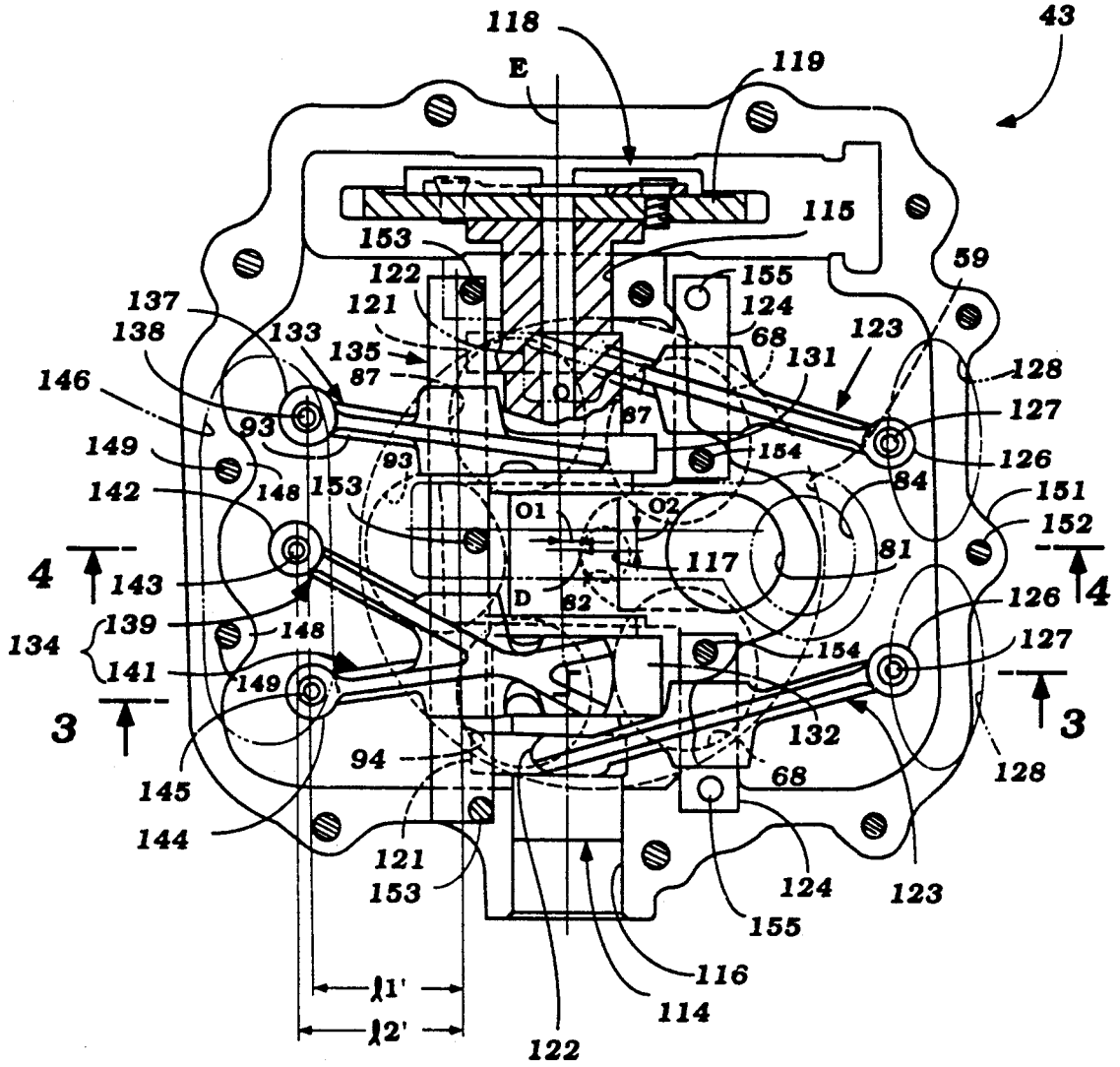
FIG. 2 is a top plan view, with portions broken away, showing the cylinder head assembly of the engine, with portions shown in section.

The exhaust valves 72 and intake valves 99, 101 and 102 are all operated by means of a single overhead camshaft 114. The camshaft 114 is journaled, in a manner to be described, for rotation about an axis E which is offset to the intake side of the cylinder head from the cylinder bore axis D by a distance 01 (FIG. 2). The axis E is parallel to the plane aforementioned that contains the axis of the cylinder bore D. The camshaft 114 has end bearing surfaces that are journaled in bearing surfaces 115 and 116 formed by the cylinder head 43 and corresponding bearing surfaces formed by the cam cover 44. In addition, there is provided a central bearing surface on the camshaft 114 that is journaled by a bearing surface 117 formed in the cylinder head 43. A corresponding bearing surface is partially formed in the cam cover 44 and has its center offset a distance O2 from the cylinder bore axis D so as to provide clearance for other components of the cylinder head assembly to be described and specifically one of the rocker arms.

The camshaft 114 is driven from the engine crankshaft by means of a drive chain (not shown) and sprocket 118 that is affixed to one end of the camshaft. A decompression device 119 is associated with the sprocket 118 and serves to reduce the starting torque on the engine by lifting slightly one of the exhaust valves 72 during starting operation.

A pair of exhaust cam lobes 121 are formed at the outer ends of the camshaft 114 adjacent the bearings that engage the cylinder head bearing surfaces 115 and 116. These cam lobes 121 are engaged by follower surfaces 122 of exhaust rocker arms 123. These exhaust rocker arms 123 are journaled on stub rocker arm shafts 124 each of which is supported by a boss 125 formed on the inner surface of the cam cover 44.

The outer ends of the rocker arms 123 are provided with taped portions 126 that receive adjusting screws 127 for providing lash adjustment between the exhaust rocker arms 123 and the tips of the stems 74 of the exhaust valves 72 for clearance adjustment. Access openings 128 are provided in the cam cover 44 for facilitating valve adjustment without removal of the cam cover 44. These access openings 128 are normally closed by closure plugs 129 which are affixed in place in a suitable manner.

In addition to the exhaust cam lobes 121, the camshaft 114 is provided with a first intake cam lobe 131 and a second intake cam lobe 132 which lobes 131 and 132 are disposed on opposite sides of the central camshaft bearing surface which is journaled in the cylinder head bearing surface 117. The cam lobes 131 and 132 cooperate with respective rocker arms 133 and 134 for opening the intake valves 99, 101 and 102, respectively, in a manner to be described. The rocker arms 133 and 134 are both journaled on a single rocker arm shaft 135 that is journaled within the bearing surfaces formed by lugs 136 of the cam cover 44. These lugs 136 also form the bearing surfaces which cooperate with the cylinder head bearing surfaces 115, 116 and 117 for journaling the camshaft 114.

It has already been noted that the intake valves 99 and 102 reciprocate about respective reciprocal axes B and the intake valve 101 reciprocates about the axis A. As has been noted that the axes A and B intersect at a line C which is parallel to the aforenoted plane containing the cylinder bore axis D which point C is spaced from the tips of all of the intake valves. However, the center intake valve 101 has its tip disposed at a somewhat higher point from the lower cylinder head surface 62 and also spaced outwardly in a horizontal direction a greater distance 12' than the tips of the side intake valves 99 and 102 which valves lie at the distance 11' from the plane and also from the pivotally axes of the respective rocker arms 133 and 134. Also, it should be noted that the center intake valve 101 and specifically its axis B is at a perpendicular distance 11 from the rocker arm shaft 113 whereas the axes of reciprocation A of the other intake valves is a perpendicular distance 12 from this axis. This distance 11 is less than the distance 12. These differences in distance permit the smooth combustion chamber configuration previously noted and also permit a variation in the amount of lift for the two valves operated from the same cam lobe and same rocker arm, this being the cam lobe 132 and rocker arm 134 in this embodiment. As a result of the greater distance to the center intake valve 101 than the side intake valves 99 and 102 a greater amount of lift may be achieved for this valve than the other two. As a result, there can be generated more air flow through the center intake passage than the side intake passages. However, since the center intake passage is longer than that of the side intake passages due to the fact that the side intakes passages extend perpendicularly whereas the center intake passages disposed at an angle, it is also possible to obtain equal flows. However, the geometric relationships described permits the designer to achieve desired flow patterns within the combustion chamber under varying running conditions.

Rocker arm 133 has an enlarged taped portion 137 that receives an adjusting screw 138 that cooperates with the tip of the stem 106 of the intake valve 99 that is associated with the primary intake passage 85. As has been previously noted, the intake passage 85 is designed primarily to accommodate low and mid range performance and hence the cam lobe 131 may be configured to provide a lift characteristic "a" as shown in FIG. 9 that is better tuned for low speed performance.

The rocker arm 134 has a pair of bifurcated arms 139 and 141 with the arm 139 having a threaded end 142 that receives an adjusting screw 143 that cooperates with the tip of the stem 101 of the center intake valve 101. The arm 141 has an enlarged taped portion 144 that receives an adjusting screw 145 that cooperates with the tip of the valve stem 107 of the intake valve 102 for clearance adjustment.

The cam cover 44 is provided with elongated opening 146 for accessing each of the adjusting screws 138, 143 and 145 so that the valve adjustment may be made without removing the cam cover. A removal closure plug 147 normally closes the opening 146 and is removed for servicing.

The cam lobe 132 associated with the rocker arm assembly 134 is configured so as to provide a greater degree of lift for both of the valves and also a longer event as shown by the curve "b" in FIG. 9. This is because the rocker arm 134 is associated with the secondary or high speed intake passage 88 of the cylinder head 43. As has also be noted, due to the difference in length of the arms 139 and 141 the center intake valve 101 may have an even greater lift than the side intake valve 102. This configuration may be done so as to improve or generate swirl in the combustion chamber. Of course and as has been previously noted, those designers in the art may incorporate these features to provide different types of valve operation and different types of tuning.

The cam cover 44 is affixed to the cylinder head 43 by a plurality of fasteners, most of which are accessible from externally of the cam cover 44. However, the cam cover 44 is provided with an inwardly extending bosses 148 (FIGS. 2 and 4) into which threaded fasteners 149 are received for affixing the cam cover 44 to the cylinder head 43. These fasteners 49 are readily accessible through the surface opening 146 when the cover 147 is removed. A corresponding lug 151 is formed on the exterior of the cam cover 44 between the two exhaust rocker arms and is secured to the cylinder head 43 by a threaded fastener 152. Further threaded fasteners, indicated by the reference numerals 153 not only serve to hold the cam cover 44 to the cylinder head 43 but also serve to prevent rotation of the rocker arm shaft 153. Other threaded fasteners 154 serve to hold the cam cover 44 to the cylinder head 43 and also serve to prevent rotation of the rocker arm shafts 124. Further threaded fasteners 155 are fastened into the cam cover and serve only the purpose of preventing rotation of the rocker arm shafts 124.

It has been noted that the intake valves 99, 101 and 102 may have the same head diameter and the center intake valve 101 may have a greater lift than the others so as to compensate for the longer flow path to it and the greater flow resistance. The same effect can be provided by reducing the head diameters of center intake valve 101. This will permit the use of smaller diameter valve springs and so on for this valve and thus facilitate the freedom of design in the valve operating system.

Because two valves are operated by the rocker arm 134 while only a single valve is operated by the rocker arm 133, the stress on the rocker arm 134 is larger. However, because the cam shaft 134 is shifted to the intake side of the engine this stress can be reduced by reducing the total length of the rocker arms.

Figure 10:
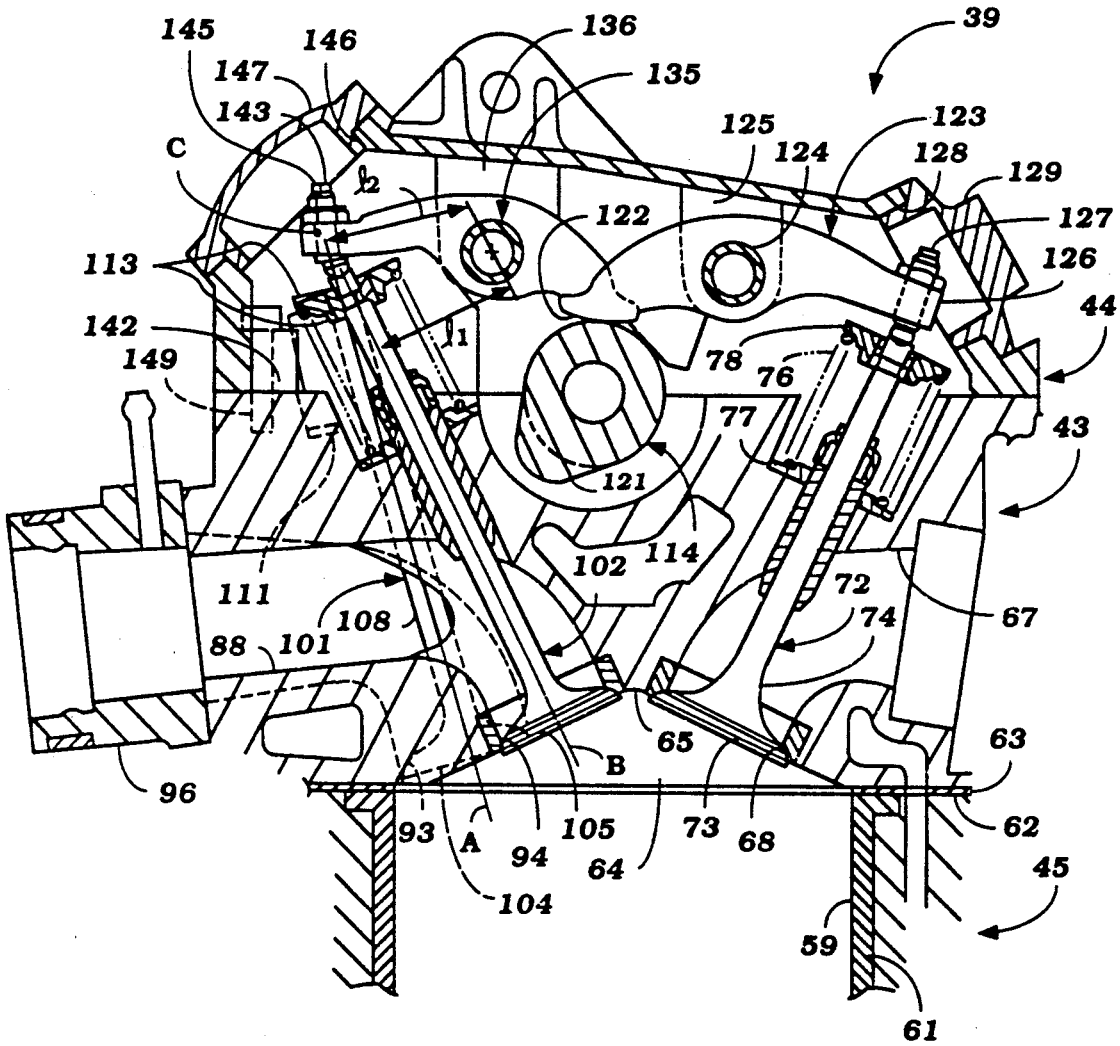
FIG. 10 is a cross sectional view, in part similar to FIG. 3 and shows another embodiment of the invention.
Figure 11:
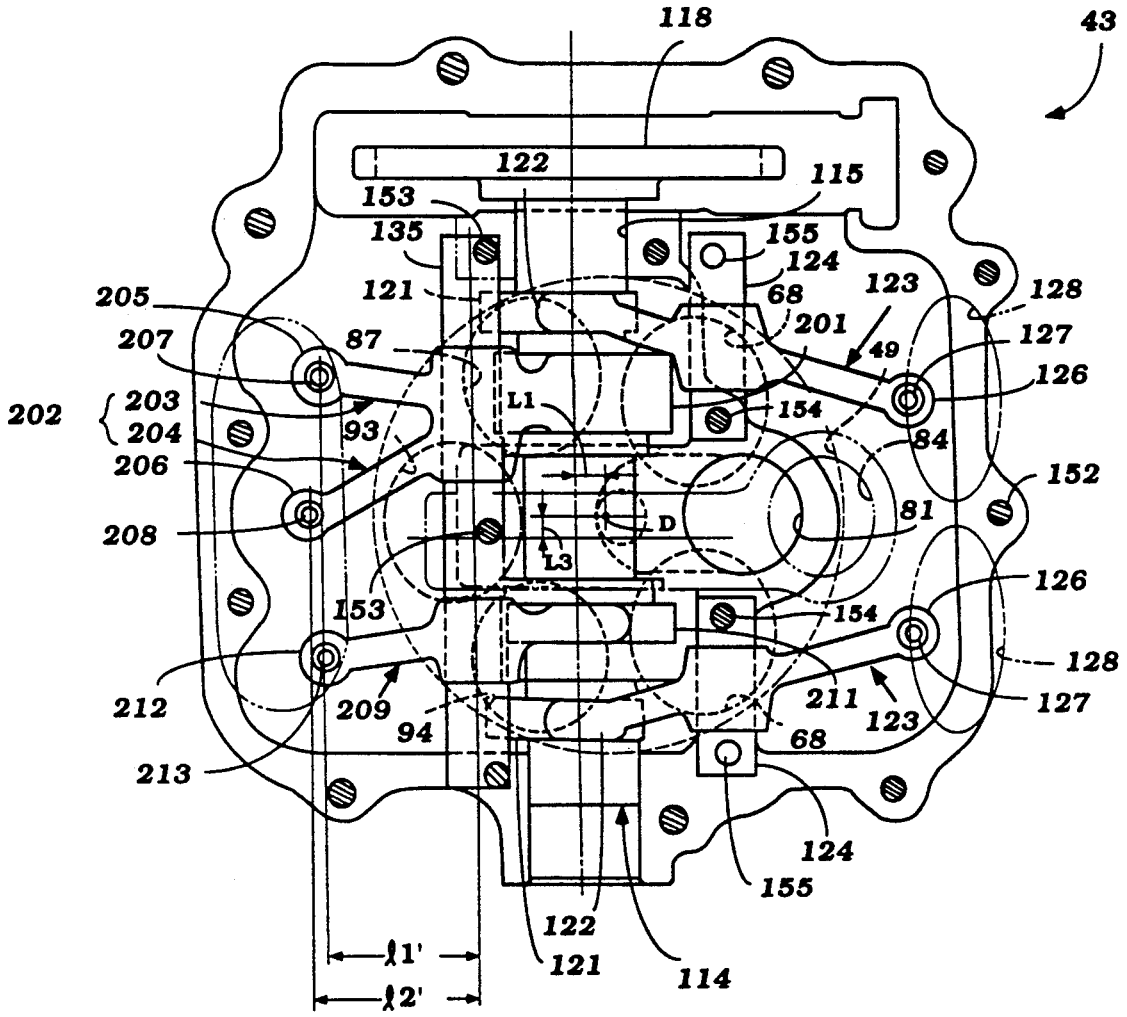
FIG. 11 is a top plan view of this embodiment.

In the embodiment of the invention as thus far described, the axes of reciprocation of the intake valves intersect at a line that lies above the tips of the valves and the center intake valve is positioned at a different distance from the cylinder head surface, from the rocker arm shafts and also from the cylinder bore in a plan view. Although this arrangement has certain advantages, some facets of the invention can also be utilized in engines wherein the intake valve stems are all at the same height and still the stems all have the same length. Also, the invention can be utilized in conjunction with an arrangement wherein the primary intake valve 99 and center intake 101 are operated by the same rocker arm and the remaining side intake valve 102 is operated by its own rocker arm. FIGS. 10 and 11 show such an embodiment and, except for the distinctions discussed above, have the same general construction of the previously described embodiment. For that reason, components which are the same or substantially the same in this embodiment have been identified by the same reference numerals and will be described again only insofar as is necessary to understand the construction and operation of this embodiment.

It should be noted that even though the tips of the valve stems of the valves 99, 101 and 102 all lie at the same vertical distance above the sealing surface 62 of the cylinder head 43 the center intake valve 101 has its tip disposed at a greater distance 12' than the distance 11' from the rocker arm shaft 135 as viewed in top plan (FIG. 11). In addition, the perpendicular distance between the axis of reciprocation of the center intake valve 101 is at a greater distance 12 than that of the side intake valves 99 and 102 (FIG. 10). As previously described, the stem lengths of the valves 99, 101 and 102 are all the same so that a single valve design may be used at each location.

In this embodiment, a larger cam lobe 201 is employed for operating a single rocker arm 202 having arm portions 203 and 204 for operating the intake valves 99 and 101, respectively. Because of this larger cam lobe, the center bearing provided by the cam cover 44 is shifted to a distance L3 from the cylinder bore axis D then in the proceeding embodiment so as to provide the necessary clearance. The rocker arm portions 203 and 204 have respective enlarged tapped portions 205 and 206 that carry adjusting screws 207 and 208 to provide valve adjustment for the valves 99 and 101.

A single rocker arm 209 engages a narrower intake cam portion 211 and has an enlarged portion 212 that carries an adjusting screw 213 for cooperation with the valve 102. The shifting of the bearing surface for the center of the cam shaft farther from the sprocket 118 gives a greater moment so that a smaller force can overcome the couples created by the downward force on the cam shaft caused by the chain cooperation with the driving sprocket 118 and the upward force by the valve action.

In the embodiments of the invention as thus far described, reference has been made to engines having three intake valves. Of course, the concept can be utilized in conjunction with engines have more than three intake valves and in such an instance the center intake valves will be paired with each other in the manner as thus far described and all stems will have the same length.

The invention has also been described in conjunction with a single cylinder engine. Of course, the invention can be employed with multiple cylinder engines and some facets of the invention have more utility in conjunction with such engines because of the ease of placement of the carburetors due to the configuration of the intake passages described. Also, although certain features of the invention have been described in conjunction with a single overhead cam engine, some features such as the configuration of the intake ports may be employed also with twin overhead camshaft engines.

It should be readily apparent from the foregoing description that the described construction permits a very compact multi-valve engine in which all of the valves which have the same stem length can be operated by a single camshaft and in which a staged induction system can be employed and in which the valve lift can be varied to suit the requirements of the designer in achieving either swirl or other motion in the combustion chamber. Of course, the foregoing description is only that of preferred embodiments of the invention and various changes and modifications may be made without departing from the spirit and scope of the invention, as defined by the appended claims.

We claim:

1. A cylinder head and valve arrangement for an internal combustion engine comprising a cylinder head assembly adapted to be affixed in sealing relation to an associated cylinder block for closing a cylinder bore therein, a pair of poppet valves supported for reciprocation within said cylinder head assembly about respective reciprocal axes each disposed at a different acute angle to a plane containing the axis of said cylinder bore, a camshaft journaled for rotation about a rotational axis lying contiguous to said plane, the axes of reciprocation of said valves intersecting at a line extending parallel to said plane at a point spaced from the tips of said valves, the stems of said valves having the same length and rocker arm means for operating said valves from said camshaft.

2. A cylinder head and valve arrangement as set forth in claim 1 wherein the tip of one of the valves is spaced at a greater distance from the plane than the tip of the other of the valves.

3. A cylinder head and valve arrangement as set forth in claim 1 wherein the rocker arm means are pivotally supported on a rocker arm shaft and wherein the perpendicular distance between the rocker arm shaft and the axis of reciprocation of one of the valves is greater than the perpendicular distance between the axis of reciprocation of the other of the valve and the rocker arm shaft.

4. A cylinder head and valve arrangement as set forth in claim 3 wherein the tip of one of the valves is spaced at a greater distance from the plane than the tip of the other of the valves.

5. A cylinder head and valve arrangement as set forth in claim 3 wherein both of the valves are operated by operator portions of a common rocker arm.

6. A cylinder head and valve arrangement as set forth in claim 3 wherein each of the valves is operated by a different rocker arm.

7. A cylinder head and valve arrangement as set forth in claim 1 further including a third valve supported for reciprocation relative to the cylinder head assembly along an axis that lies in a common plane with the reciprocal axis of one of the first pair of valves and having the same stem length as the other valve.

8. A cylinder head and valve arrangement as set forth in claim 7 wherein the tip of one of the valves is spaced at a greater distance from the plane than the tip of the other of the valves.

9. A cylinder head and valve arrangement as set forth in claim 7 wherein the rocker arm means are pivotally supported on a rocker arm shaft and wherein the perpendicular distance between the rocker arm shaft and the axis of reciprocation of one of the valves is greater than the perpendicular distance between the axis of reciprocation of the other of the valves and the rocker arm shaft.

10. A cylinder head and valve arrangement as set forth in claim 9 wherein the tip of one of the valves is spaced at a greater distance from the plane than the tip of the other of the valves.

11. A cylinder head and valve arrangement as set forth in claim 9 wherein two of the valves are operated by the same rocker arm.

12. A cylinder head and valve arrangement as set forth in claim 11 further including a second rocker arm for operating the remaining valve from the camshaft.

13. A cylinder head and valve arrangement as set forth in claim 7 further including a first intake passage extending through the cylinder head from a first intake port to a first valve seat controlled by one of the pair of poppet valves and a second siamese intake passage extending from a second intake port in the cylinder head to a pair of valve seats controlled by the other of the pair of poppet valves and the third poppet valve.

14. A cylinder head and valve arrangement as set forth in claim 13 wherein the first intake passage extends perpendicular to the plane and the second intake passage from the second intake port to the third valve seat extends perpendicular to the plane and from the second intake port to the second valve seat extends at an angle to the plane.

15. A cylinder head and valve arrangement as set forth in claim 13 further including staged throttle valve means for controlling the flow through the intake passages so that the low speed and mid range running performance is served by the first intake passage and the high speed condition is served by both of the intake passages.

16. A cylinder head and valve arrangement as set forth in claim 15 wherein the one of the pair of poppet valves is operated by a first rocker arm and the other of the pair of poppet valves and the third poppet valve is operated by a common second rocker arm.

17. A cylinder head and valve arrangement as set forth in claim 15 wherein both of the pairs of poppet valves are operated by a common rocker arm and the third poppet valve is operated by a second rocker arm.

18. A cylinder head and valve arrangement for an internal combustion engine comprising a cylinder head assembly adapted to be affixed in sealing relation to an associated cylinder block for closing a cylinder bore therein, a pair of poppet valves supported for reciprocation within said cylinder head assembly about respective reciprocal axes each disposed at a different acute angle to a plane containing the axis of said cylinder bore and having the same stem length, a camshaft journaled for rotation about a rotational axis lying contiguous to said plane, the tips of the stems of said valves lying at different distances from the associated cylinder block, and rocker arm means for operating said valves from said camshaft.

19. A cylinder head and valve arrangement as set forth in claim 18 further including a third valve supported for reciprocation relative to the cylinder head assembly along an axis that lies in a common plane with the reciprocal axis of one of the first pair of valves and having the same stem length as the first pair of valves.

20. A cylinder head and valve arrangement as set forth in claim 19 wherein the tip of one of the valves is spaced at a greater distance from the plane than the tip of the other of the valves.

21. A cylinder head and valve arrangement as set forth in claim 19 wherein the rocker arm means are pivotally supported on a rocker arm shaft and wherein the perpendicular distance between the rocker arm shaft and the axis of reciprocation of one of the valves is greater than the perpendicular distance between the axis of reciprocation of the other valves and the rocker arm shaft.

22. A cylinder head and valve arrangement as set forth in claim 21 wherein the tip of one of the valves is spaced at a greater distance from the plane than the tip of the other valves.

23. A cylinder head and valve arrangement as set forth in claim 21 wherein two of the valves are operated by the same rocker arm.

24. A cylinder head and valve arrangement as set forth in claim 23 further including a second rocker arm for operating the remaining valve from the camshaft.

25. A cylinder head and valve arrangement as set forth in claim 19 further including a first intake passage extending through the cylinder head from a first intake port to a first valve seat controlled by one of the pair of poppet valves and a second siamese intake passage extending from a second intake port in the cylinder head to a pair of valve seats controlled by the other of the pair of poppet valves and the third poppet valve.

26. A cylinder head and valve arrangement as set forth in claim 21 wherein the first intake passage extends perpendicular to the plane and the second intake passage from the second intake port to the third valve seat extends perpendicular to the plane and from the second intake port to the second valve seat extends at an angle to the plane.

27. A cylinder head and valve arrangement as set forth in claim 21 further including staged throttle valve means for controlling the flow through the intake passages so that the low speed and mid range running performance is served by the first intake passage and the high speed condition is served by both of the intake passages.

28. A cylinder head and valve arrangement as set forth in claim 27 wherein the one of the pair of poppet valves is operated by a first rocker arm and the other of the pair of poppet valves and the third poppet valve is operated by a common second rocker arm.

29. A cylinder head and valve arrangement as set forth in claim 27 wherein both of the pairs of poppet valves are operated by a common rocker arm and the third poppet valve is operated by a second rocker arm.

30. A cylinder head and valve arrangement for an internal combustion engine comprising a cylinder head assembly adapted to be affixed in sealing relationship to an associated cylinder block for closing a cylinder bore therein, a pair of poppet valves supported for reciprocation within said cylinder head assembly about respective reciprocal axes each disposed at a different acute angle to a plane containing the axis of said cylinder bore, a camshaft journaled for rotation about a rotational axis lying contiguous to said plane, the tips of the stems of said valves lying a different distances from said plane and rocker arm means for operating said valves from said camshaft, said stems all having the same length.

31. A cylinder head and valve arrangement as set forth in claim 30 further including a third valve supported for reciprocation relative to the cylinder head assembly along an axis that lies in a common plane with the reciprocal axis of one of the first pair of valves.

32. A cylinder head and valve arrangement as set forth in claim 31 wherein the tip of one of the valves is spaced at a greater distance from the plane than the tip of the other valves.

33. A cylinder head and valve arrangement as set forth in claim 31 wherein the rocker arm means are pivotally supported on a rocker arm shaft and wherein the perpendicular distance between the rocker arm shaft and the axis of reciprocation of one of the valves is greater than the perpendicular distance between the axis of reciprocation of the other valves and the rocker arm shaft.

34. A cylinder head and valve arrangement as set forth in claim 33 wherein the tip of one of the valves is spaced at a greater distance from the plane than the tip of the other valves.

35. A cylinder head and valve arrangement as set forth in claim 33 wherein two of the valves are operated by the same rocker arm.

36. A cylinder head and valve arrangement as set forth in claim 35 further including a second rocker arm for operating the remaining valve from the camshaft.

37. A cylinder head and valve arrangement as set forth in claim 31 further including a first intake passage extending through the cylinder head from a first intake port to a first valve seat controlled by one of the pair of poppet valves and a second siamese intake passage extending from a second intake port in the cylinder head to a pair of valve seats controlled by the other of the pair of poppet valves and the third poppet valve.

38. A cylinder head and valve arrangement as set forth in claim 37 wherein the first intake passage extends perpendicular to the plane and the second intake passage from the second intake port to the third valve seat extends perpendicular to the plane and from the second intake port to the second valve seat extends at an angle to the plane.

39. A cylinder head and valve arrangement as set forth in claim 37 further including staged throttle valve means for controlling the flow through the intake passages so that the low speed and mid range running performance is served by the first intake passage and the high speed condition is served by both of the intake passages.

40. A cylinder head and valve arrangement as set forth in claim 39 wherein the one of the pair of poppet valves is operated by a first rocker arm and the other of the pair of poppet valves and the third poppet valve is operated by a common second rocker arm.

41. A cylinder head and valve arrangement as set forth in claim 39 wherein both of the pairs of poppet valves are operated by a common rocker arm and the third poppet valve is operated by a second rocker arm.

42. A cylinder head and valve arrangement for an internal combustion engine comprising a cylinder head assembly adapted to be affixed in sealing relationship to an associated cylinder block for closing a cylinder bore therein, a pair of poppet valves supported for reciprocation within said cylinder head assembly about respective reciprocal axes each disposed at a different acute angle to a plane containing the axis of said cylinder bore, said valves all having the same stem length, a camshaft journaled for rotation about a rotational axis lying contiguous to said plane, and rocker arm means for operating said valves from said camshaft, said rocker arm means being pivotal about an axis extending parallel to said plane, said reciprocal axes of said valves being spaced different perpendicular distances from said rocker arm axis.

43. A cylinder head and valve arrangement as set forth in claim 42 further including a third valve supported for reciprocation relative to the cylinder head assembly along an axis that lies in a common plane with the reciprocal axis of one of the first pair of valves and having the stem of the same length as the first pair of valves.

44. A cylinder head and valve arrangement as set forth in claim 43 wherein the tip of one of the valves is spaced at a greater distance from the plane than the tip of the other valves.

45. A cylinder head and valve arrangement as set forth in claim 44 wherein two of the valves are operated by the same rocker arm.

46. A cylinder head and valve arrangement as set forth in claim 45 further including a second rocker arm for operating the remaining valve from the camshaft.

47. A cylinder head and valve arrangement as set forth in claim 43 further including a first intake passage extending through the cylinder head from a first intake port to a first valve seat controlled by one of the pair of poppet valves and a second siamese intake passage extending from a second intake port in the cylinder head to a pair of valve seats controlled by the other of the pair of poppet valves and the third poppet valve.

48. A cylinder head and valve arrangement as set forth in claim 47 wherein the first intake passage extends perpendicular to the plane and the second intake passage from the second intake port to the third valve seat extends perpendicular to the plane and from the second intake port to the second valve seat extends at an angle to the plane.

49. A cylinder head and valve arrangement as set forth in claim 47 further including staged throttle valve means for controlling the flow through the intake passages so that the low speed and mid range running performance is served by the first intake passage and the high speed condition is served by both of the intake passages.

50. A cylinder head and valve arrangement as set forth in claim 49 wherein the one of the pair of poppet valves is operated by a first rocker arm and the other of the pair of poppet valves and the third poppet valve is operated by a common second rocker arm.

* * * * *